United States Patent [19]

Nartowski

[11] 4,008,297

[45] Feb. 15, 1977

[54] AUTOMATIC STARTING DEVICE OF CARBURETOR

[75] Inventor: Andre Nartowski, Boulogne-Billancourt, France

[73] Assignees: Regie Nationale des Usines Renault Boulogne-Billancourt; Automobiles Peugeot, Paris, both of France

[22] Filed: Sept. 16, 1975

[21] Appl. No.: 613,872

[30] Foreign Application Priority Data

Sept. 23, 1974 France ..... 74.32010

[52] U.S. Cl. ..... 261/39 B; 261/52

[51] Int. Cl.[2] ..... F02M 1/10

[58] Field of Search ..... 261/52, 39 B

[56] References Cited

UNITED STATES PATENTS

| | | | |
|---|---|---|---|
| 3,006,618 | 10/1961 | Carlson et al. | 261/52 |
| 3,151,189 | 9/1964 | McSeveny | 261/52 |
| 3,263,972 | 8/1966 | Braun et al. | 261/52 |
| 3,291,462 | 12/1966 | Mennesson | 261/52 |
| 3,575,389 | 4/1971 | Goto et al. | 261/52 |
| 3,740,040 | 6/1973 | Brown et al. | 261/52 |
| 3,785,624 | 1/1974 | Marsee | 261/52 |

*Primary Examiner*—Tim R. Miles
*Attorney, Agent, or Firm*—Fleit & Jacobson

[57] ABSTRACT

In this automatic starting device for internal combustion engine carburetors, comprising a strangler starter shutter, linkage means for controlling this shutter incorporating a temperature responsive element, a cam connected through spring means to said shaft and coacting with the positive throttle control linkage, said cam having a first cam face controlling the normal idling position of said throttle, followed by another cam face controlling the accelerated idling position thereof, the strangler starter shutter control linkage further comprises resilient connecting means adapted to yield in the fully open position of said shutter, the accelerated idling cam face extending in such a manner that it will still co-act along a predetermined stroke with said positive throttle control linkage after said shutter has reached its fully open position.

1 Claim, 5 Drawing Figures

AUTOMATIC STARTING DEVICE OF CARBURETOR

The present invention relates to improvements in or relating to starting devices of carburetors or internal combustion engines.

Nowadays in most Countries, anti-pollution regulations are becoming increasingly severe and lead to carburetor adjustments close to the limit beyond which the proper operation of the engine is impaired.

To reduce the penality incurred by the pollution developing during the cold phase of the engine temperature cycle, an obvious solution seemed to be a reduction of the time during which the carburetor starter is operative. This earlier elimination of the starter action must therefore take place before the engine has attained its normal running temperature.

Now if this shorter starter action is applied to an automatic starter device, which is eliminated or turned-off rather rapidly, the engine will stall when resuming the idling condition which is generally required for adhering to anti-pollution regulations, this stalling being most likely to occur detrimentally under normal driving conditions.

It is therefore the essential object of the present invention to avoid this inconvenience by modifying a conventional automatic starting device whereby the usual and necessary enriching of the air/fuel mixture can be eliminated relatively rapidly, within a normal or even reduced operating time, while preserving at the same time a positive opening of the throttle until the engine has attained the normal temperature for warm running. This positive throttle opening will extend the accelerated idling condition usually contemplated, during a time period determined by the test and try method, whereby when the engine has attained its above-mentioned normal running temperature the positive throttle opening will be eliminated automatically to the benefit of a normal warranted idling speed.

To this end, the present invention, in an automatic starting device of internal combustion engine carburetor comprising a starter strangler shutter mounted in the air induction pipe upstream of a starter jet, a strangler shutter control linkage comprising a shaft having a variable angular position and connected to a temperature responsive member capable under cold running condition to keep said strangler shutter closed and to gradually open said strangler shutter as the engine temperature rises, a cam operatively connected through spring means to the angular position of said shaft and adapted to co-act with a linkage for positively controlling the position of the carburetor throttle, said cam comprising a cam face for controlling the initial opening of the throttle and another cam face adapted to hold said throttle in a position corresponding to a somewhat accelerated idling speed of the engine, is characterised in that the strangler starter shutter control linkage incorporates resilient connecting means adapted to yield when said strangler starter shutter is fully open, and that said accelerated idling control cam face extends in such a manner that it can co-act during a certain stroke length with said positive throttle control linkage subsequent to the opening of said strangler starter shutter.

In order to afford a clearer understanding of the features and advantages of the present invention, a conventional starter device and the modification thereof according to the teachings of this invention will now be described in detail with reference to the attached drawings, in which.

Figure 1:
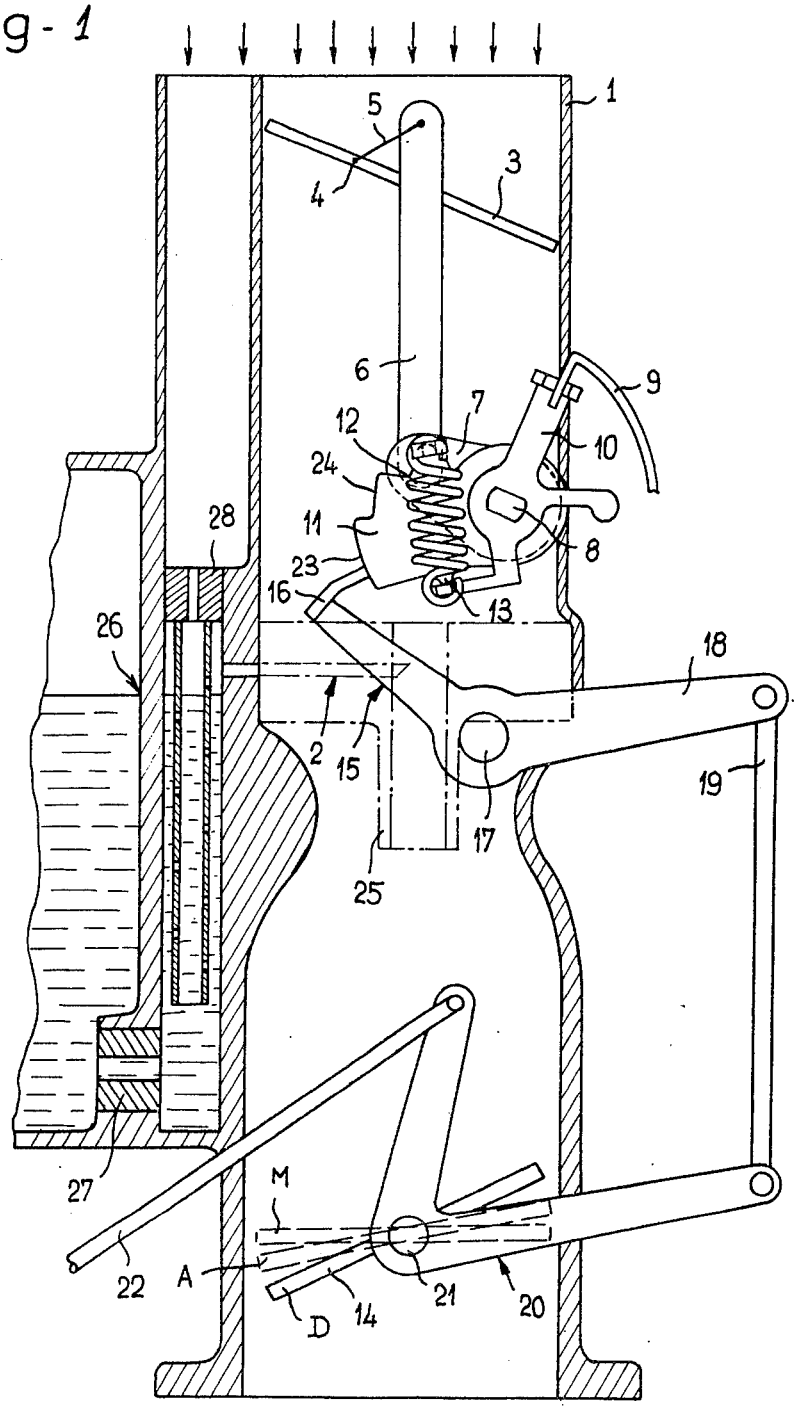
FIG. 1 is a diagrammatic view of a conventional prior art automatic starter device shown in its normal position preliminary to the starting of the cold engine.

The prior art automatic starting device of internal combustion engine carburetor illustrated in FIG. 1 comprises, in the induction air pipe 1 of the carburetor body and upstream of the jet means 2 having the dual function of starter jet and main jet, an offset strangler starter shutter 3 pivoted to a shaft 4.

Mounted to this shaft 4 is an arm 5 of an external control linkage further comprising a link 6 pivoted at one end to said arm 5 and at the opposite end to a lever 7 rotatably solid with a control shaft 8 of which the angular position is variable and controlled by an element responsive to the engine temperature. This temperature responsive element consists in this example of a conventional spiral bimetallic strip shown only diagrammatically and partially at 9 which is its movable end attached to a lever 10 also rigid with shaft 8. Also mounted to this shaft 8 but for loose rotation is a cam 11 connected to said lever 10 via a traction spring 12 constantly urging said cam 11 to a position in which it abutes against said lever 10. This cam 11 is operatively connected to a linkage for positively controlling the engine throttle 14, this linkage comprising a bell-crank lever 15 solid with a cam follower 16; this lever 15 is fulcrumed to a shaft 17 and has one arm 17 connected via a link 19 to another bell-crank lever 20 rigid with the throttle shaft 21 and also responsive to the throttle control linkage 22 leading to the accelerator pedal (not shown), the return spring usually associated with this control linkage being also omitted for the sake of clarity in the drawing; this return spring, as usual, normally urges the assembly to its inoperative condition in which the throttle is closed, while urging at the same time the follower 16 for engagement with cam 11. This cam 11 comprises a first cam face 23 controlling the starting position of throttle 14 (position D in thick lines in FIG. 1), and another adjacent cam face 24 adapted to provide an accelerated idling position (shown at A in dot and dash lines in FIG. 1) with respect to the normal idling position with a warm engine (shown in dot and dash lines at M in FIG. 1). There are also shown in FIG. 1 and just as a reminder the emulsion tube 25 of the carburetor which is disposed between the strangler starter shutter and the main throttle, as well as the means for supplying fuel to the jet means 2, in this example from the constant-level or float chamber 26 of the carburetor through a main jet 27 and a pilot jet 28.

Figure 2:
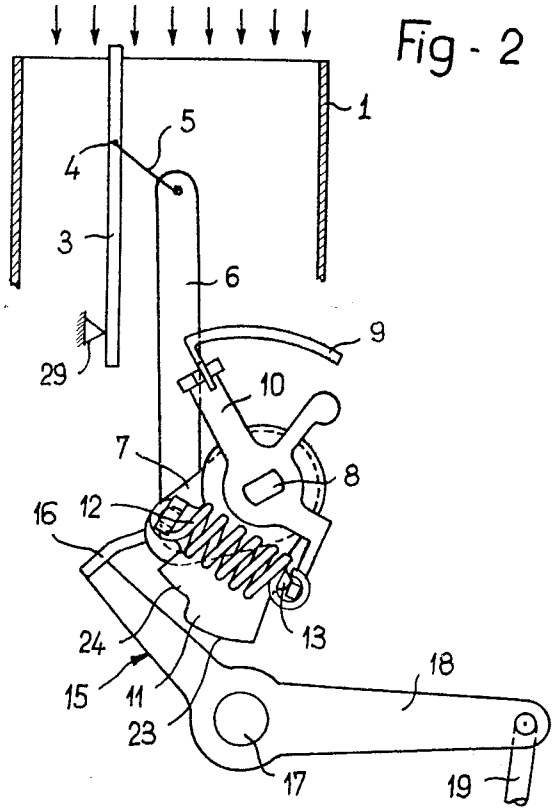
FIG. 2 is a view similar to FIG. 1, from which unnecessary details are omitted, showing the prior art device in the position corresponding to the operation of the engine after warming up.

The fixed support of shaft 8 and of the bimetallic strip 9 on the carburetor body is not shown for the sake of clarity, inasmuch as the above-described device is well known in the art and operates as follows:

When the engine is driven by the starter motor, the air suction through the intake tube 1 tends to open the shutter 3, this tendency being counteracted by the torque produced by the bimetallic strip 9 and coil spring 12, the cam 11 being substantially held against motion by the engagement of follower 16 therewith. However, when the driver accelerates the engine by voluntarily opening the throttle 14, the torque counteracting the opening of said shutter 3 is only that of said bimetallic strip 9. Now this torque decreases as the engine temperature increases, and it may be emphasized that the provision of spring 12 serves the purpose of allowing a progressive opening of said shutter in case the cam 11 remained initially locked against movement by said follower 16. Thus, the shutter 3 is gradually urged to its fully open position illustrated in FIG. 2, in which it engages a stop 29, whereby after a phase takes place during which said follower 16 registers with the other cam face 24 controlling the accelerated idling speed of the engine, which follows the initial opening cam face 23, said follower 16 eventually escaping from this cam face before or when the shutter 3 has attained its fully open position corresponding to the warm engine operation, wherein the main throttle 14 can resume its normal idling position M somewhat less open than its accelerated idling position A controlled by said first cam face 23. It is thus clear that the function of the change in the positive opening of the gas throttle, i.e., the passage from the accelerated idling speed to the normal idling speed of the engine, is closely related to the function of the opening of the starter shutter, and must take place in due time, before or at the same time as this last-mentioned function.

Figure 3:
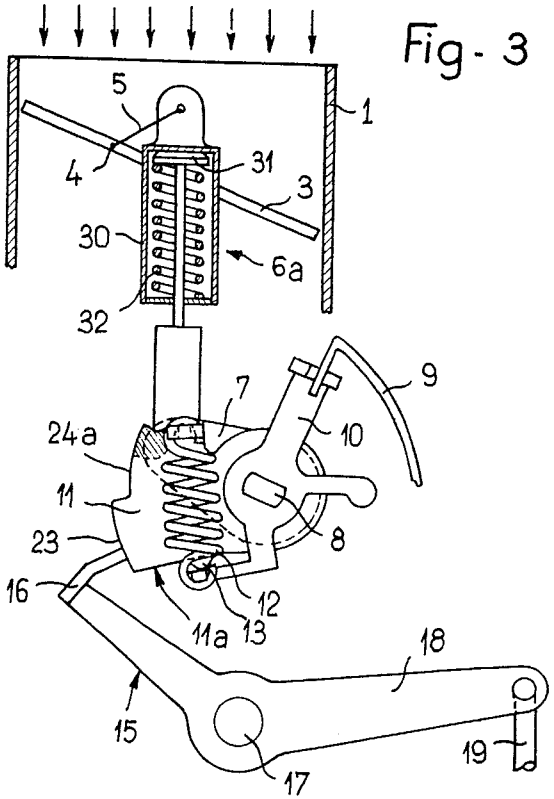
FIG. 3 is a diagrammatic illustration of the automatic starter device of this invention shown in its normal position preliminary to the starting of the cold engine.
Figure 5:
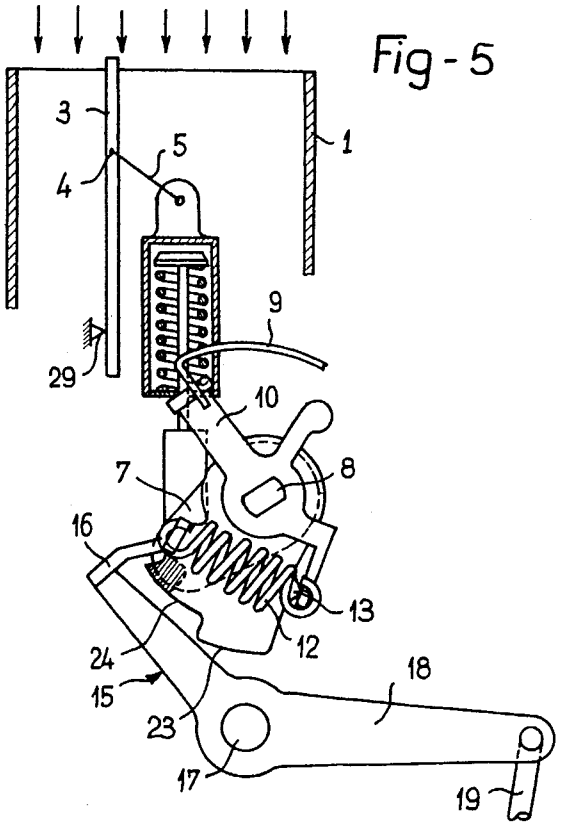
FIG. 5 is a view similar to FIG. 3 but showing the starter device thereof after passing from the accelerated idling position to the normal idling position with a warm engine.
Figure 4:
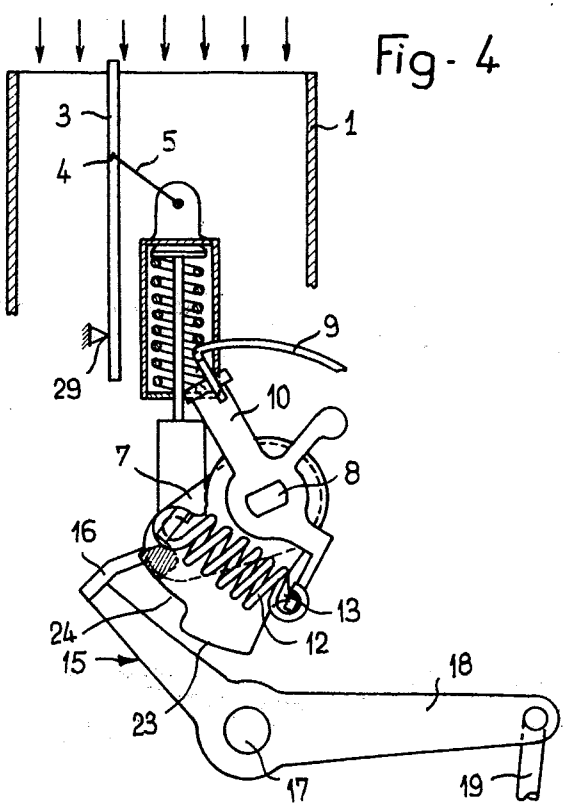
FIG. 4 is a view similar to FIG. 3, showing the device when the strangler starter shutter is in its fully open position.

Now it is the primary object of the device constituting the subject-matter of the present invention, which is illustrated in FIGS. 3, 4 and 5 of the drawings, to render these two functions as defined hereinabove independent of each other, thus affording the possibility of changing the richness of the air/fuel mixture controlled by the opening of said strangler starter shutter independently of the change of engine speed which is responsive to the follower and cam mechanism subordinate in turn to the engine temperature.

The component elements of the assembly illustrated in FIGS. 3 to 5 which are identical with those of FIG. 1 are designated by the same reference numerals. Besides, the other component elements not shown in these FIGS. 3 to 5 remain unchanged.

Instead of a rigid link 6, the arrangement according to this invention provides a resilient linkage between the levers 5 and 7 which comprises a telescopic unit **6*a* consisting of a cylinder 30, a piston 31, and a coil compression spring 32 interposed between the bottom of said cylinder 30 and said piston 31, so as to constantly urge said piston 31 towards its innermost position in said cylinder 30. Moreover, a cam 11*a* having a longer accelerated idling cam face 24*a* than cam 11 of the prior art device is provided, as shown by the closely hatched portion of said FIGS. 3 to 5**.

The operation of this improved device departs from that of the prior art device when the strangler starter shutter is in its fully open position in which, as shown in FIG. 4, the follower 16 still engages the accelerated idling cam face **24*a***, this shutter opening movement being liable to occur either at the same time as or later than in the preceding prior art example during the engine warming up phase.

The resulting increment in the torque produced by the bimetallic strip 9, as illustrated in FIG. 5, is attended by an elongation of the telestopic link **6*a*, thus permitting a rotation of cam 11*a* such that the cam face 24*a* thereof will retract in relation to follower 16**, and that the minimum opening of the engine throttle is restored to the value corresponding to the normal idling position at a predetermined or selected engine temperature which is higher than the temperature whereat the starter shutter begins to open.

Although a specific form of embodiment of this invention has been described hereinabove with reference to the accompanying drawings, it will readily occur to those conversant with the art that various modifications and changes may be brought thereto without departing from the scope of the invention as set forth in the appended claims.

What is claimed as new is:

1. The automatic starting device of carburetors of internal combustion engines, which comprises a strangler starter shutter disposed upstream of a starter jet, a linkage for controlling said shutter incorporating a variable angular position shaft operatively connected to a temperature responsive element capable in the cold engine condition to keep said shutter closed and to gradually open same as the engine warms up, a cam freely rotatable relative to said shaft and connected through spring means to an element movable with said shaft and adapted to co-act with the linkage means positively controlling the carburetor throttle, said cam comprising a first cam face controlling the normal starter idling position of said throttle, followed by another cam face adapted to set said throttle in an accelerated idling position, said strangler starter shutter control linkage further comprising resilient connecting means adapted to yield when said shutter is fully open while said accelerated idling throttle control cam face has such amplitude that it can still co-act along a predetermined stroke with said positive throttle control linkage after said strangler starter shutter has reached its fully open position.

* * * * *